US006374568B1

(12) United States Patent
Hamlin

(10) Patent No.: US 6,374,568 B1
(45) **Date of Patent: *Apr. 23, 2002**

(54) ROLLED SHINGLE ROOFING MATERIAL AND METHOD OF INSTALLATION

(76) Inventor: H. Lee Hamlin, 2935 Broadway, Macon, GA (US) 31206

( * ) Notice: Subject to any disclaimer, the term of this patent is extended or adjusted under 35 U.S.C. 154(b) by 0 days.

This patent is subject to a terminal disclaimer.

(21) Appl. No.: 09/455,095

(22) Filed: Dec. 6, 1999

Related U.S. Application Data

(63) Continuation-in-part of application No. 08/934,554, filed on Sep. 22, 1997, now Pat. No. 5,996,300.

(51) Int. Cl.[7] ..... E04D 15/00
(52) U.S. Cl. ..... 52/749.12; 206/397; 294/158
(58) Field of Search ..... 52/518, 523, 524, 52/528, 748.1, 749.13, 558, DIG. 16, 554, 555, 557, 314, 315, 749.12; 428/906; 294/158; 206/390, 397

(56) References Cited

U.S. PATENT DOCUMENTS 4,757,652 A * 7/1988 Kalkanoglu ..... 52/559
5,037,685 A * 8/1991 Richards et al. ..... 52/518
5,501,056 A * 3/1996 Hannah et al. ..... 52/748.1
5,548,940 A * 8/1996 Baldock ..... 52/518

* cited by examiner

*Primary Examiner*—Michael Safavi
(74) *Attorney, Agent, or Firm*—Harry I. Leon

(57) ABSTRACT

An assembly including rolled roofing material that can be easily installed on a roof and a special handling tool. The tool reduces the strain of carrying the roofing material and of raising to the roof. The roofing material, fabricated as an elongated strip which defines a plurality of narrow slots extending perpendicularly from one longitudinal edge thereof, can be formed into a roll or rolled onto a hollow cylinder. The handling tool includes a "U"-shaped tube in which one of its branches is inserted through the hollow core formed by the rolled roofing material itself or, alternately, the hollow cylinder upon which material has been wound. The branch of the "U"-shaped tube so inserted can then be used as an attachment point for a rope, useful in raising the roll of roofing material to the roof. Or one can use the distal end of the "U"-shaped tube as a handle to facilitate carrying the rolled roofing material and placing it on the roof.

1 Claim, 5 Drawing Sheets

ROLLED SHINGLE ROOFING MATERIAL AND METHOD OF INSTALLATION

REFERENCE TO PRIOR U.S. PATENT APPLICATION

This application is a continuation-in-part of my U.S. patent application having Ser. No. 08/934,554, filed Sep. 22, 1997 now U.S. Pat. No. 5,996,300.

BACKGROUND OF THE INVENTION

This invention relates to roofing materials and their installation.

In the past, shingles made of asphalt, fiberglass, and the like have been provided in flat packages. Each of these shingles typically measures about 3 feet long and about 1 foot wide and is precut so as to form two parallel slits. Extending about half way across the shingle from one of its longitudinal edges, the slits are disposed about a foot apart and divide the roofing material into three tabs. The remainder of the shingle, also known as the uncut slip, includes a face which is usually coated with a thermally activated adhesive material. Activated when the shingles are exposed to the sun, this adhesive is used to hold the shingles in an overlapping arrangement, with one shingle partially covering the other. The shingles are made so that when they are properly installed, the top shingle covers about one-half the transverse width of the bottom shingle and the slits in contiguous overlapping shingles do not align with each other.

When standard shingles are packaged for sale, they are usually sold in packages, each package having a stack of about 27 shingles which cover approximately 33.75 square feet. A protective sheet of plastic or waxed paper is placed between contiguous pairs of shingles to keep the adhesive from bonding them together before use. This protective sheet is thrown away as the shingles are being unstacked, immediately prior to placement.

During a roofing job, it is customary for the workmen to carry an unopened stack of shingles up a ladder, open the package on the roof, remove the shingles one at a time, place them in position and then nail or staple them in place. This procedure tends to generate problems. They arise, in part, because the weight of each stack of shingles, which is about 70 pounds, and its awkward shape make carrying the shingles up a ladder difficult. Also, a stack of shingles resting on a sloping roof can easily slide off of it. Further, individually placing each shingle is a time-consuming chore.

SUMMARY OF THE INVENTION

The object of this invention is to provide a shingle that is easier to handle and install. A further object is to provide an inexpensive tool to facilitate lifting shingles to the roof and placing them there.

In the applicant's earlier invention, there was provided an improved roofing material in which individual shingles are held together, end to end, by a plastic joining membrane or a connector. In the present invention, there is provided an improved rolled shingle roofing material which does not require the use of such a joining membrane. Rather, during manufacture of the material, narrow slots are cut therein at longitudinally spaced apart intervals, each slot extending inwardly from one edge of the material to generally the mid-section thereof. In the preferred embodiment, the spacing between contiguous slots is about one foot in length; and each slot measures, by way of example, about 5 inches long and ¼ inch wide. With slots so configured, a roof covered with the rolled shingle roofing material according to the present invention closely resembles one covered with standard shingles. The slots allow the roofing material to undergo thermal expansion, extending its useful service lifetime.

The improved roofing material, which is made so that it will not crack or otherwise break when rolled, can be fabricated of one of the newer, non-brittle types of roofing currently marketed in stacks as flat sheets. Prior to installation, the roofing material is wound around a hollow tube to facilitate storage and transport.

To facilitate lifting the improved roofing material to the roof and installing it, there is provided a handling tool including a tube bent into a "U"-shape defining first and second branches and a pair of cylindrical disks each having a centrally disposed hole formed therein for receiving one of the branches of the "U". In use, the disks are held at the ends of the hollow core of a roll of the roofing material and said branch, inserted through the hollow core and both disks, is held in assembled relation with them by a cap which threadedly engages the end of the tube distal from its handle. In addition, means for attaching a rope such as an eyelet is preferably affixed to the cap.

A roll of improved roofing can be lifted to the roof either by using the handle of the handling tool to carry it or by attaching a rope to the eyelet. With the latter approach, a worker on the roof can easily pull up the roll. Once on the roof, the roll is opened in the area where it is to be installed and fastened to the roof as it is unrolled.

DESCRIPTION OF THE PREFERRED EMBODIMENT

Figure 1:
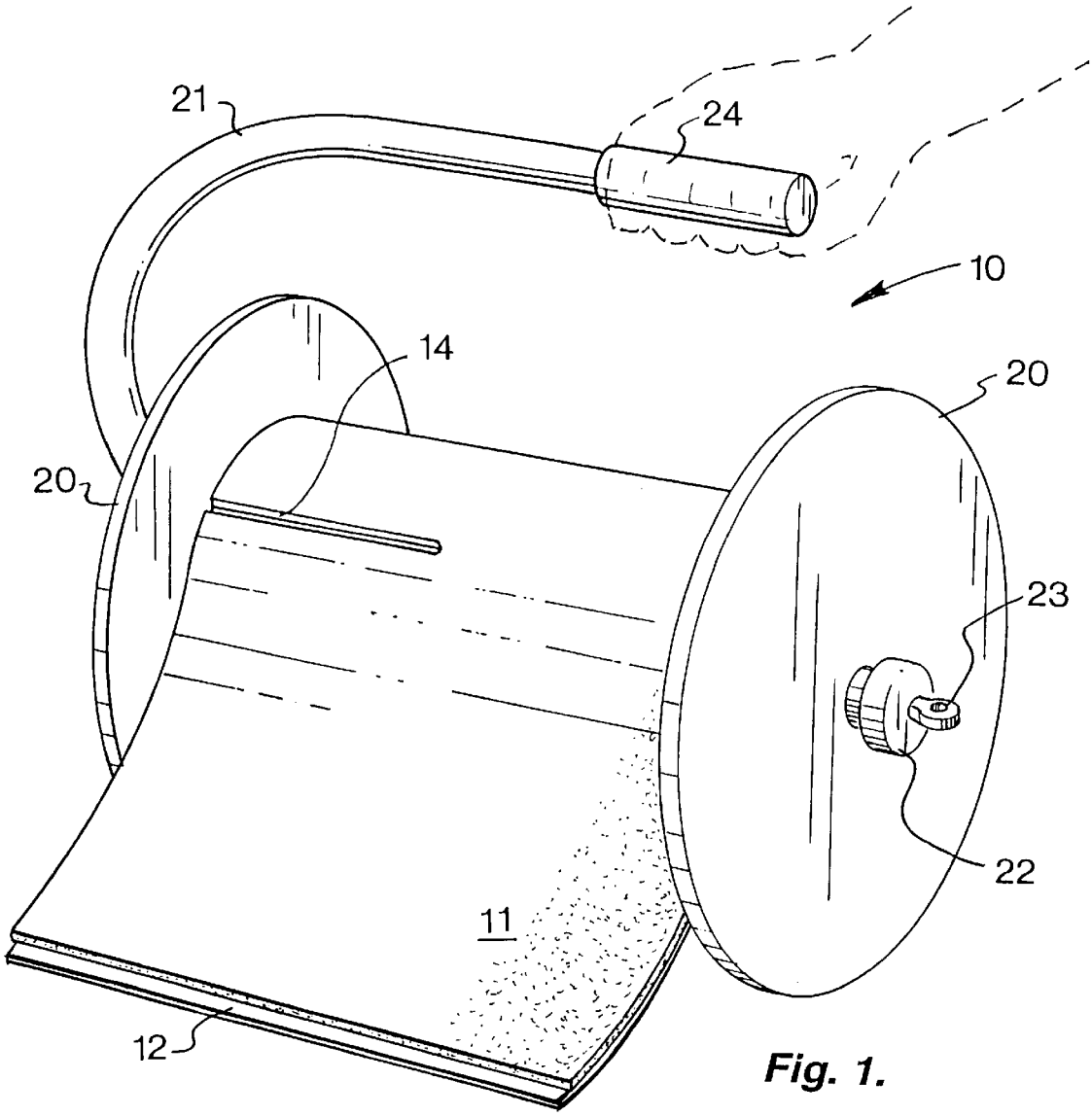
FIG. 1 is a perspective view of a roll of shingle roofing material and a handling tool therefor according to the present invention, the roofing material being shown partly unrolled with the remainder thereof mounted on the handling tool; the dashed outline of a worker's hand being shown for illustrative purposes only.
Figure 3:
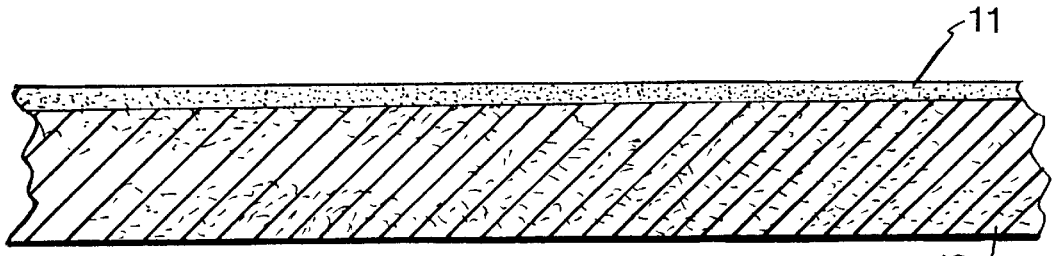
FIG. 3 is an enlarged transverse cross-section of the shingle roofing material.

In accordance with the present invention, an assembly, which is indicated generally by the reference numeral 10, comprises an elongated strip of roofing material having an outer granular layer 11 bonded to a substrate 12, the material being sufficiently flexible to tolerate rolling, and means for handling the roofing material when it formed into a roll. The substrate 12 is made from a bituminous material such as asphalt or preferably a combination of bituminous material and fiberglass. The strip of roofing material can have the same composition as certain shingles formed of fiberglass-reinforced bituminous material or the like, currently marketed in stacks as flat sheets. Specifically, an elongated strip of roofing material having the same composition as fiberglass-reinforced shingles manufactured by Manville is satisfactory. Alternately, the elongated strip can be fabricated from modified asphalt or modified bituminous material to which one or more polymers including styrene, butadiene styrene, atactic polypropylene, and ethylene propylene diene monomer has been added.

For storage, the strip of roofing material is preferably rolled on itself so as to form a hollow core with an inner diameter of about 5 inches. Alternately, the strip is rolled on a hollow cylinder which is about 5 inches in diameter. As a finished roll, the roofing material has a cylindrical shape which measures about 12 inches in diameter. But rolls with other diameters can also be used.

Figure 2:
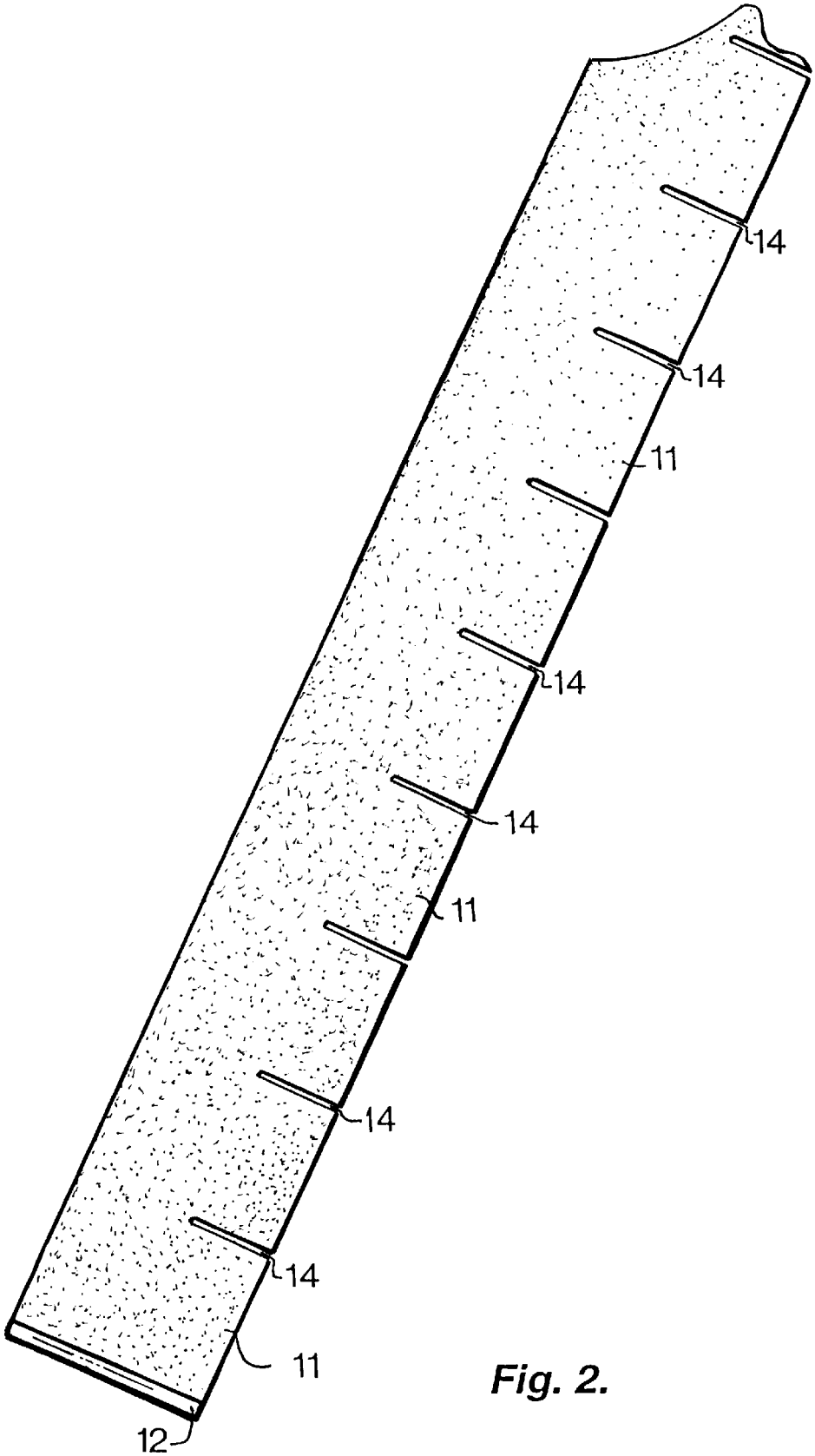
FIG. 2 is a plan view, on a reduced scale, of a fragmentary portion of the shingle roofing material according to FIG. 1 in an unrolled state.
Figure 4:
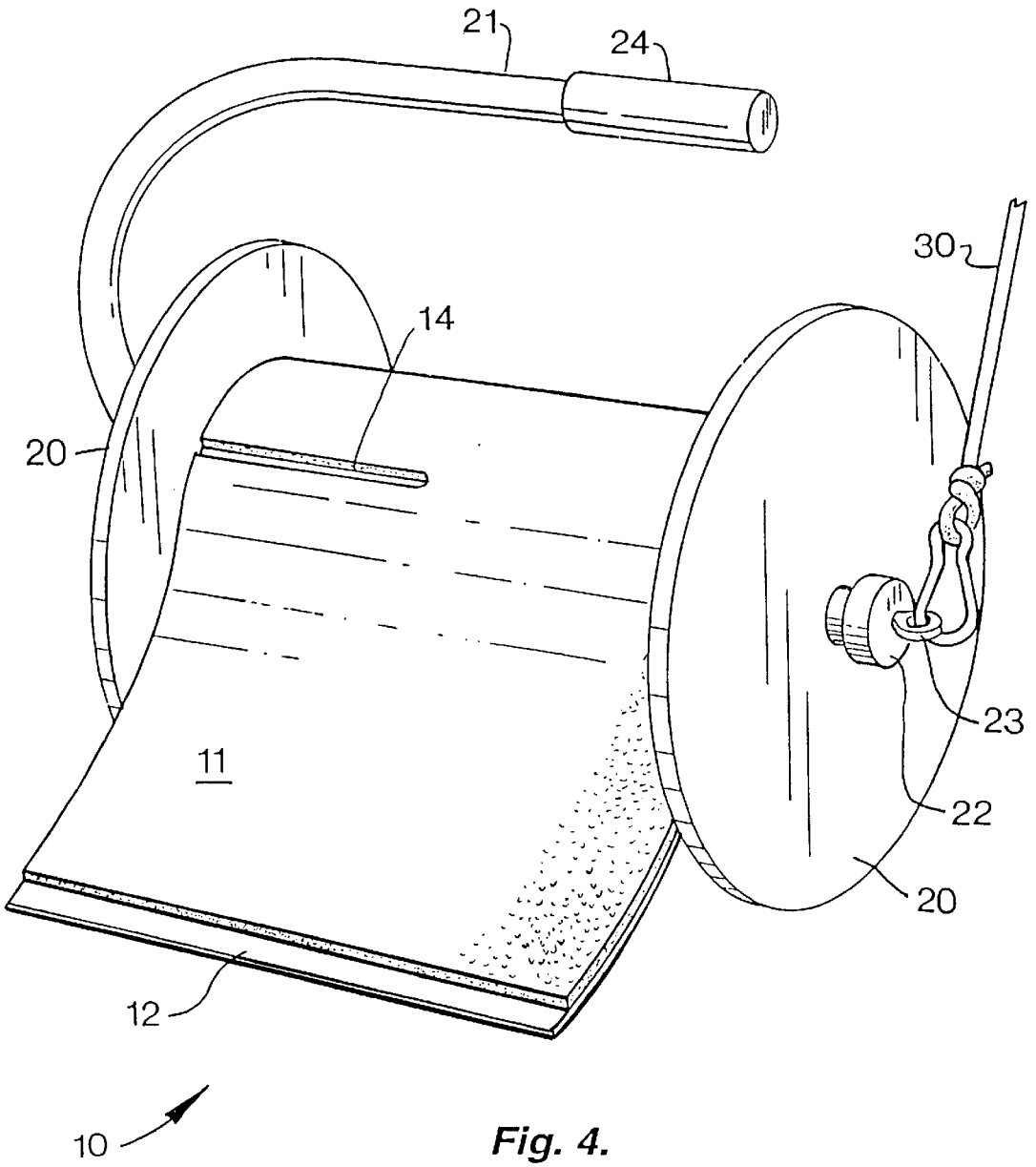
FIG. 4 is a perspective view of the handling tool according to FIG. 1, with a roll of roofing material mounted thereon and with a rope attached thereto.
Figure 5:
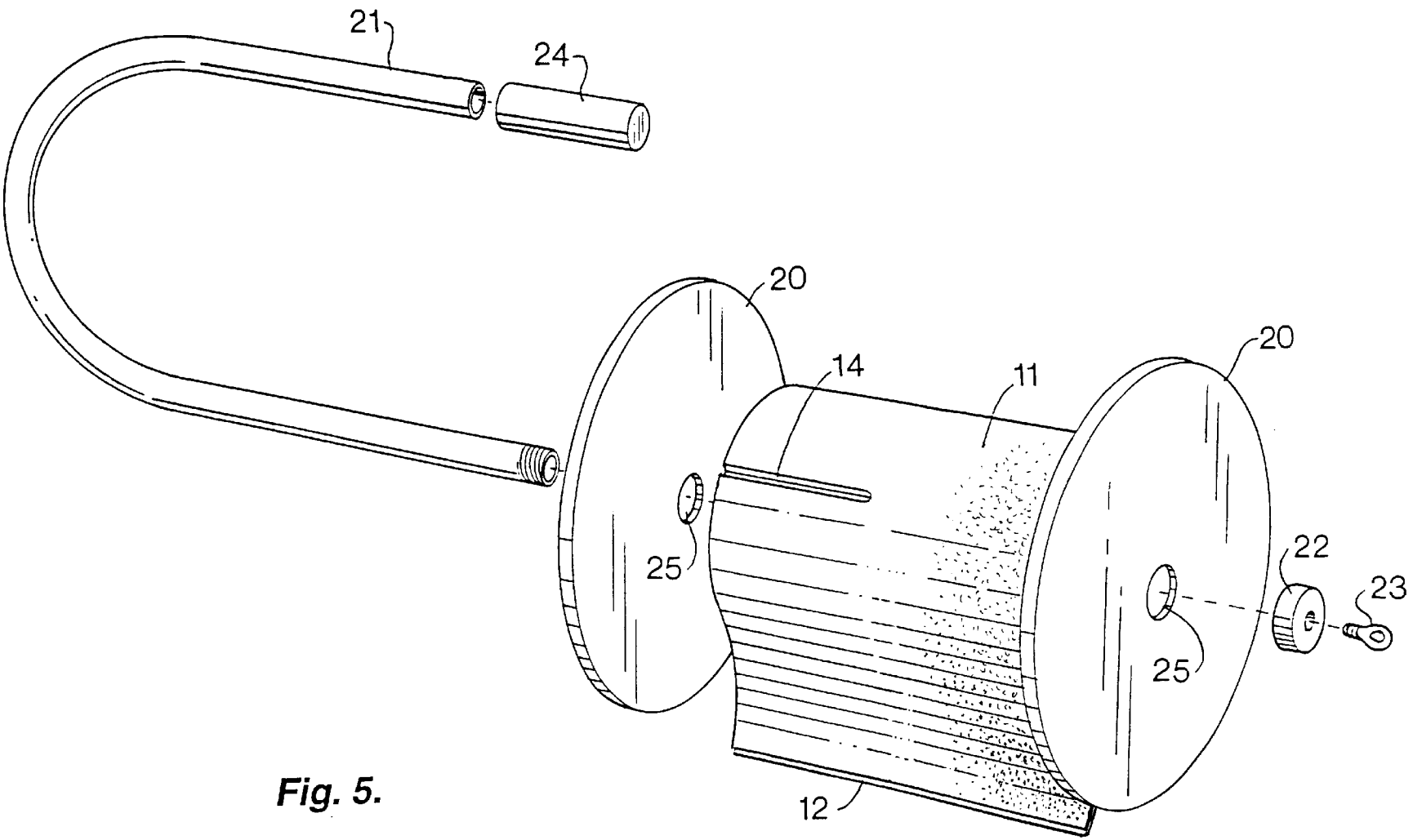
FIG. 5 is an exploded perspective view of the handling tool according to FIG. 4.

As is best seen in FIG. 2, the strip of roofing material defines a plurality of thermal expansion slots 14. Each slot 14, in the preferred embodiment, measures, by way of example, about ¼ inch wide and about 5 inches long.

Alternately, the slots can be sufficiently long that fasteners (not shown) such as nails, screws or the like can be inserted into the distal ends thereof, thereby securing the strip of roofing material to a roof. Pre-cut openings (not shown), separated from the slots 14, can also be formed in the strip of roofing material to accommodate these fasteners.

In a further alternate embodiment, some of the slots 14 can be longer than others; and the spacing between contiguous pairs of slots can be varied, so that the roofing material, when installed, creates a "designer" pattern. Moreover, the strip of roofing material can define inverted V-shaped cutaways, "dragon teeth", square-edged "dental mold", scalloped edges and the like (not shown).

Figure 6:
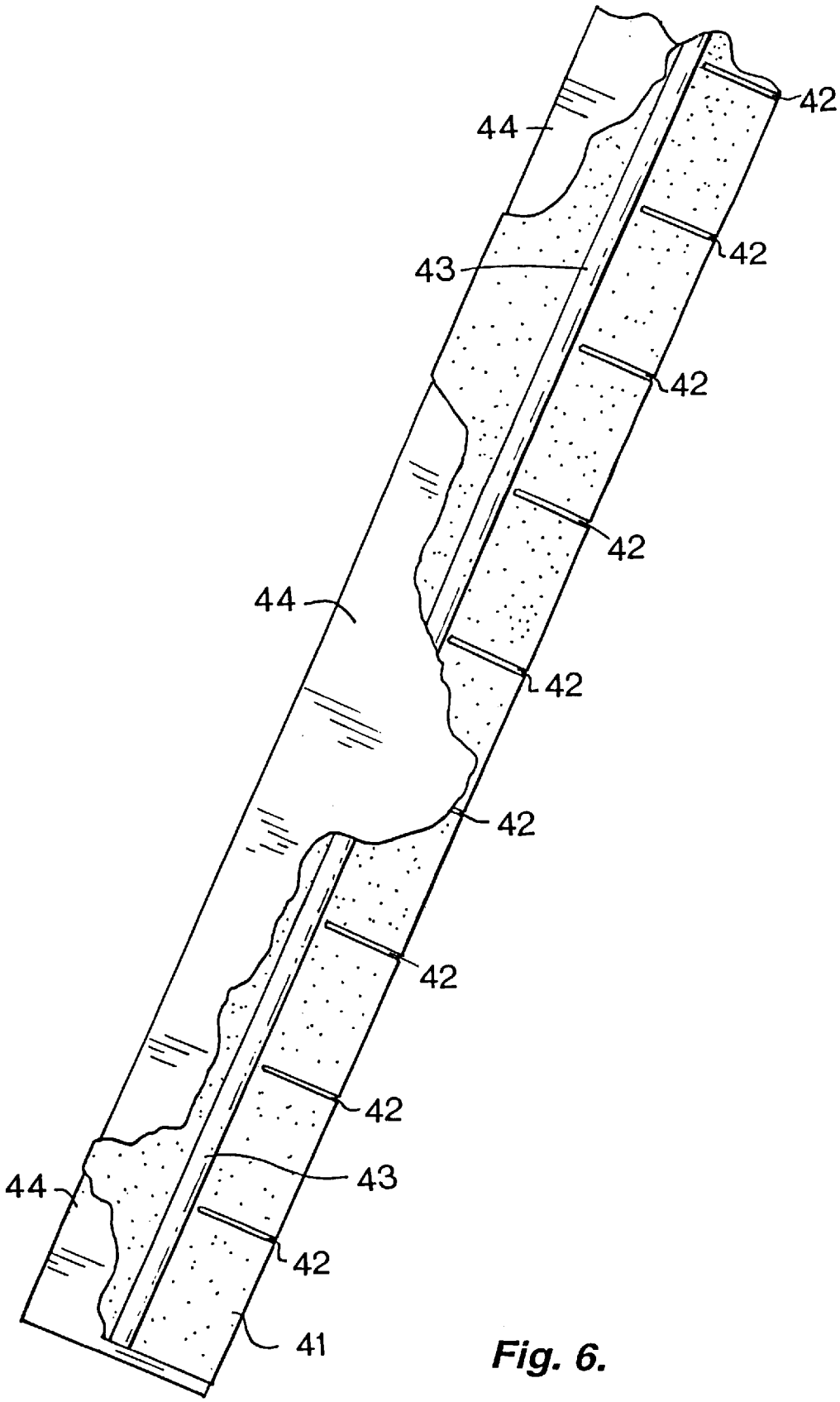
FIG. 6 is a plan view, on a reduced scale, of a fragmentary portion of an alternate embodiment of the shingle roofing material according to FIG. 1 in an unrolled state.

In a still further alternate embodiment, a track of thermally-activated adhesive 43 is disposed on portions of an elongated strip 41 which face outwardly when it is attached to a roof (FIG. 6). This track of adhesive 43, which is spaced apart from the slots 42 by a distance, which preferably measures about ½ inch, is used to hold strips 41 of roofing material in partially overlapping rows after installation. Alternately, the thermally-activated adhesive can be applied to the strip of rollable roofing material at spaced-apart intervals making a pattern of dots or the like or spread across the bottom portion of the strip.

A release sheet 44 fabricated of vinyl, polypropylene, fiberglass or the like and a pressure-sensitive tape is applied to the underside of the strip 41 in order to keep the adhesive 43 from bonding to contiguous portions of this roofing material when it is rolled for storage (FIG. 6). Preferably, the membrane 44 remains in place after the strip 41 is secured to the roof, thereby adding to the strength of the rollable roofing material.

Preferably, each elongated strip 41 of rollable roofing material is manufactured with an alignment line (not shown) which is disposed between the upper ends of the slots 42 and the track of adhesive 43 to facilitate installation of contiguous strips of roofing material, so that they can be properly aligned, generally parallel to each other.

A method of installing designer shingles includes separately attaching elongated strips 41 of rollable roofing material to a roof in such a way that at least two elongated strips, when affixed thereto, generally cover only surface areas of the roof which the first strip by itself would have covered. Elongated strips of roofing material which define transverse slot patterns of variegated lengths, inverted V-shaped cutaways, "dragon teeth", square-edged "dental mold", scalloped edges and the like can be used, creating patterns for aesthetic purposes. In addition, elongated strips of rollable roofing material of various colors can be utilized to achieve further architectural effects. This improved method eliminates extremely time-consuming techniques, including the demanding work of positioning flat shingles on a roof at a 45 degree angle to each other, as are currently employed to create architectural or designer shingles.

A handling tool for this rolled roofing material includes a tube 21, preferably made of metal, which bent into a "U"-shape and a pair of cylindrical disks 20 fabricated of metal, plastic, wood or the like. Each of the disks 20 has a centrally disposed hole 25 formed therein for receiving a branch of the "U". In use, the disks 20 are held at the ends of the hollow core of the rolled roofing material and this branch, inserted through both disks and the hollow core, is held in assembled relation with the disks by a cap 22 which is threadedly engageable with the end of the tube 21 distal from its handle 24. In the preferred embodiment, the disks 20, which measure about 1 foot in diameter, are fabricated of metal, plastic, fiberboard or a combination thereof.

In addition, the cap 22 has an eyelet 23 affixed thereto. The eyelet 23 is sized to receive a rope or cable 30, useful in using the handling tool to lift a roll of roofing material 10 mounted thereon. Alternately, one can use a hand grip 24 mounted on the end of the tube 21 distal from the cap 22 to carry the assembly 10.

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

It is claimed:

1. An assembly comprising:

(a) a roll of roofing material, the roofing material defining an elongated strip; and (b) means for hoisting the roll of roofing material, the hoisting means comprising a "U"-shaped tube defining first and second branches and a pair of cylindrical disks, each disk having a centrally disposed hole formed therein for receiving the first branch, and means for securing the roll of roofing material, the pair of cylindrical disks, and the first branch in assembled relation with the roll of roofing material being juxtaposed between the disks.

* * * * *